US009133722B2

(12) United States Patent
LeBegue et al.

(10) Patent No.: US 9,133,722 B2
(45) Date of Patent: Sep. 15, 2015

(54) TRANSITION DUCT WITH LATE INJECTION IN TURBINE SYSTEM

(75) Inventors: Jeffrey Scott LeBegue, Simpsonville, SC (US); Ronnie Ray Pentecost, Travelers Rest, SC (US); James Scott Flanagan, Simpsonville, SC (US); Won-Wook Kim, Simpsonville, SC (US); Kevin Weston McMahan, Greer, SC (US)

(73) Assignee: General Electric Company, Schenectady, NY (US)

( * ) Notice: Subject to any disclaimer, the term of this patent is extended or adjusted under 35 U.S.C. 154(b) by 695 days.

(21) Appl. No.: 13/459,516

(22) Filed: Apr. 30, 2012

(65) Prior Publication Data

US 2013/0283804 A1 Oct. 31, 2013

(51) Int. Cl.

| | |
|---|---|
| ***F23R 3/34*** | (2006.01) |
| ***F01D 9/02*** | (2006.01) |
| ***F23R 3/06*** | (2006.01) |
| ***F23R 3/28*** | (2006.01) |
| ***F23R 3/46*** | (2006.01) |

(52) U.S. Cl.

CPC . *F01D 9/023* (2013.01); *F23R 3/06* (2013.01); *F23R 3/286* (2013.01); *F23R 3/346* (2013.01); *F23R 3/46* (2013.01); *F23R 2900/03044* (2013.01)

(58) Field of Classification Search

CPC ..... F23R 3/002; F23R 3/04; F23R 3/045; F23R 3/06; F23R 3/42; F23R 3/425; F23R 3/46; F01D 9/023

USPC ..... 60/752, 754, 759, 733, 740, 806

See application file for complete search history.

(56) References Cited

U.S. PATENT DOCUMENTS

| | | | | |
|---|---|---|---|---|
| 3,652,181 | A * | 3/1972 | Wilhelm, Jr. | 415/117 |
| 4,422,288 | A | 12/1983 | Steber | |
| 5,077,967 | A | 1/1992 | Widener et al. | |
| 5,118,120 | A | 6/1992 | Drerup et al. | |
| 5,149,250 | A | 9/1992 | Plemmons et al. | |
| 5,249,920 | A | 10/1993 | Shepherd et al. | |
| 5,414,999 | A | 5/1995 | Barnes | |
| 5,457,954 | A | 10/1995 | Boyd et al. | |
| 5,592,820 | A | 1/1997 | Alary et al. | |
| 5,761,898 | A | 6/1998 | Barnes et al. | |
| 5,826,429 | A * | 10/1998 | Beebe et al. | 60/723 |

(Continued)

FOREIGN PATENT DOCUMENTS

| | | |
|---|---|---|
| EP | 1239117 A2 | 9/2002 |
| EP | 2375167 A2 | 10/2011 |
| EP | 2383518 A2 | 11/2011 |

OTHER PUBLICATIONS

Search Report and Written Opinion from EP Application No. 13157044.2 dated Aug. 19, 2013.

*Primary Examiner* — Steven Sutherland

(74) *Attorney, Agent, or Firm* — Dority & Manning, P.A.

(57) ABSTRACT

A system for supplying an injection fluid to a combustor is disclosed. The system includes a transition duct comprising an inlet, an outlet, and a passage extending between the inlet and the outlet and defining a longitudinal axis, a radial axis, and a tangential axis. The outlet of the transition duct is offset from the inlet along the longitudinal axis and the tangential axis. The passage defines a combustion chamber. The system further includes a tube providing fluid communication for the injection fluid to flow through the transition duct and into the combustion chamber.

18 Claims, 9 Drawing Sheets

(56) References Cited

U.S. PATENT DOCUMENTS

| | | | | |
|---|---|---|---|---|
| 5,839,283 | A | 11/1998 | Dobbeling | |
| 5,934,687 | A | 8/1999 | Bagepalli et al. | |
| 6,076,835 | A | 6/2000 | Ress et al. | |
| 6,202,420 | B1 | 3/2001 | Zarzalis et al. | |
| 6,203,025 | B1 | 3/2001 | Hayton | |
| 6,431,555 | B1 | 8/2002 | Schroder et al. | |
| 6,431,825 | B1 | 8/2002 | McLean | |
| 6,442,946 | B1 | 9/2002 | Kraft et al. | |
| 6,471,475 | B1 | 10/2002 | Sasu et al. | |
| 6,537,023 | B1 | 3/2003 | Aksit et al. | |
| 6,564,555 | B2 | 5/2003 | Rice et al. | |
| 6,652,229 | B2 | 11/2003 | Lu | |
| 6,662,567 | B1 | 12/2003 | Jorgensen | |
| 6,769,257 | B2 * | 8/2004 | Kondo et al. | 60/730 |
| 7,007,480 | B2 | 3/2006 | Nguyen et al. | |
| 7,024,863 | B2 | 4/2006 | Morenko | |
| 7,181,914 | B2 | 2/2007 | Pidcock et al. | |
| 7,584,620 | B2 | 9/2009 | Weaver et al. | |
| 7,637,110 | B2 | 12/2009 | Czachor et al. | |
| 7,665,309 | B2 * | 2/2010 | Parker et al. | 60/776 |
| 7,721,547 | B2 | 5/2010 | Bancalari et al. | |
| 2010/0037617 | A1 | 2/2010 | Charron et al. | |
| 2010/0037618 | A1 | 2/2010 | Charron et al. | |
| 2010/0037619 | A1 | 2/2010 | Charron | |
| 2010/0115953 | A1 | 5/2010 | Davis, Jr. et al. | |
| 2010/0180605 | A1 | 7/2010 | Charron | |

* cited by examiner

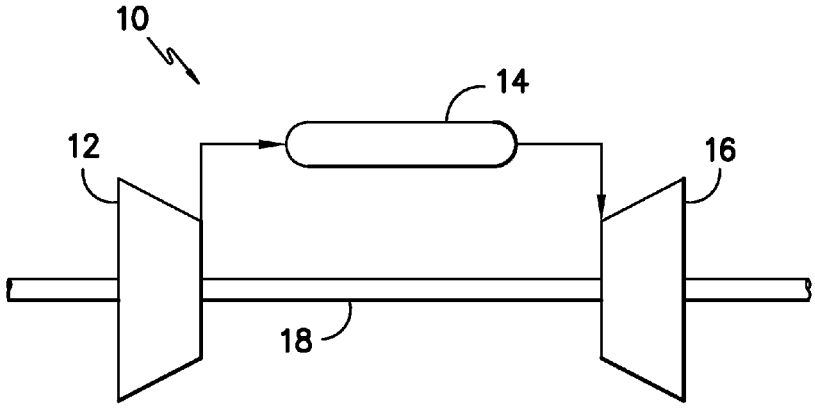
FIG. –1–
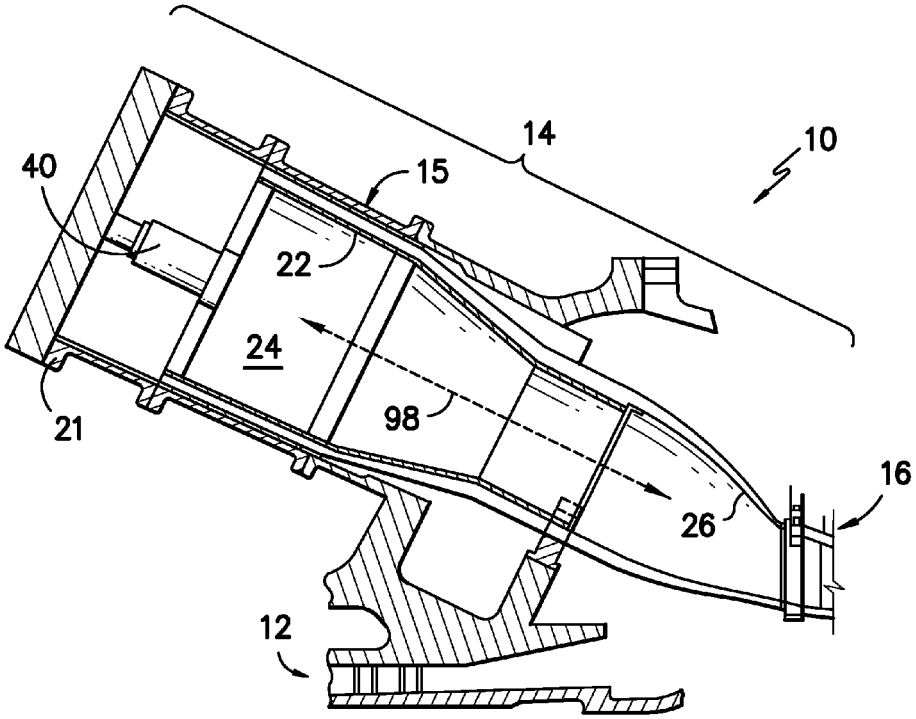
FIG. –2–

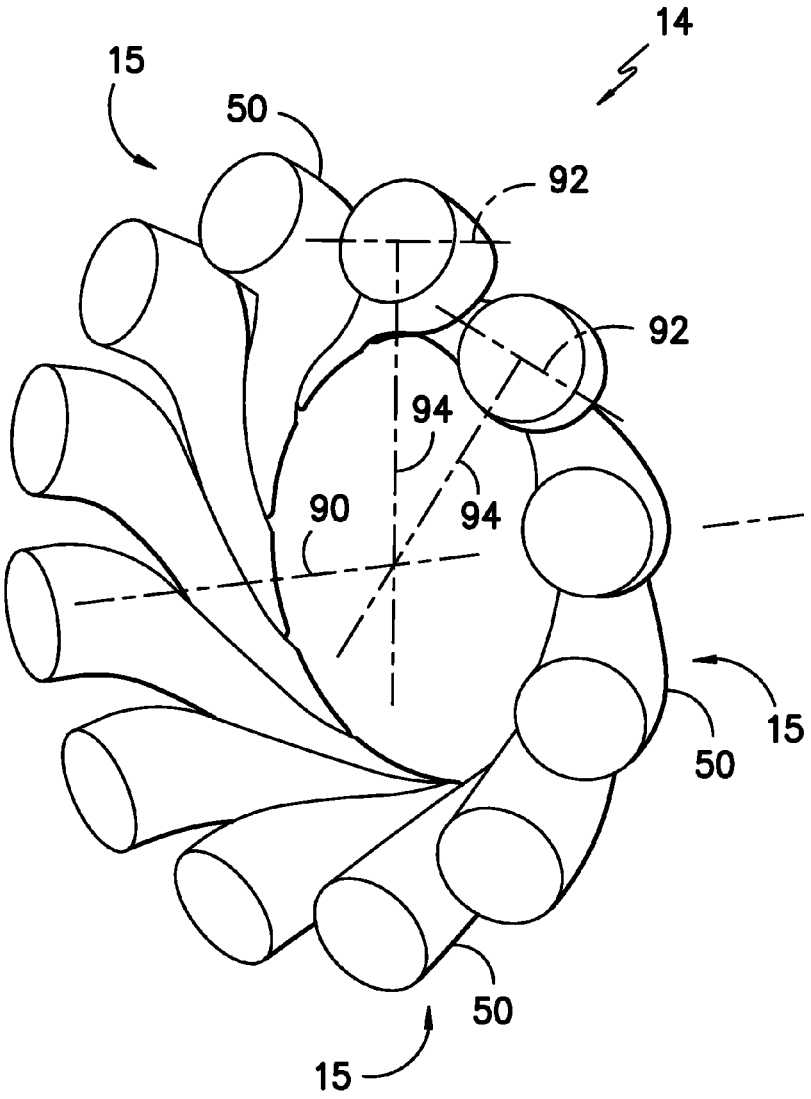
FIG. –3–

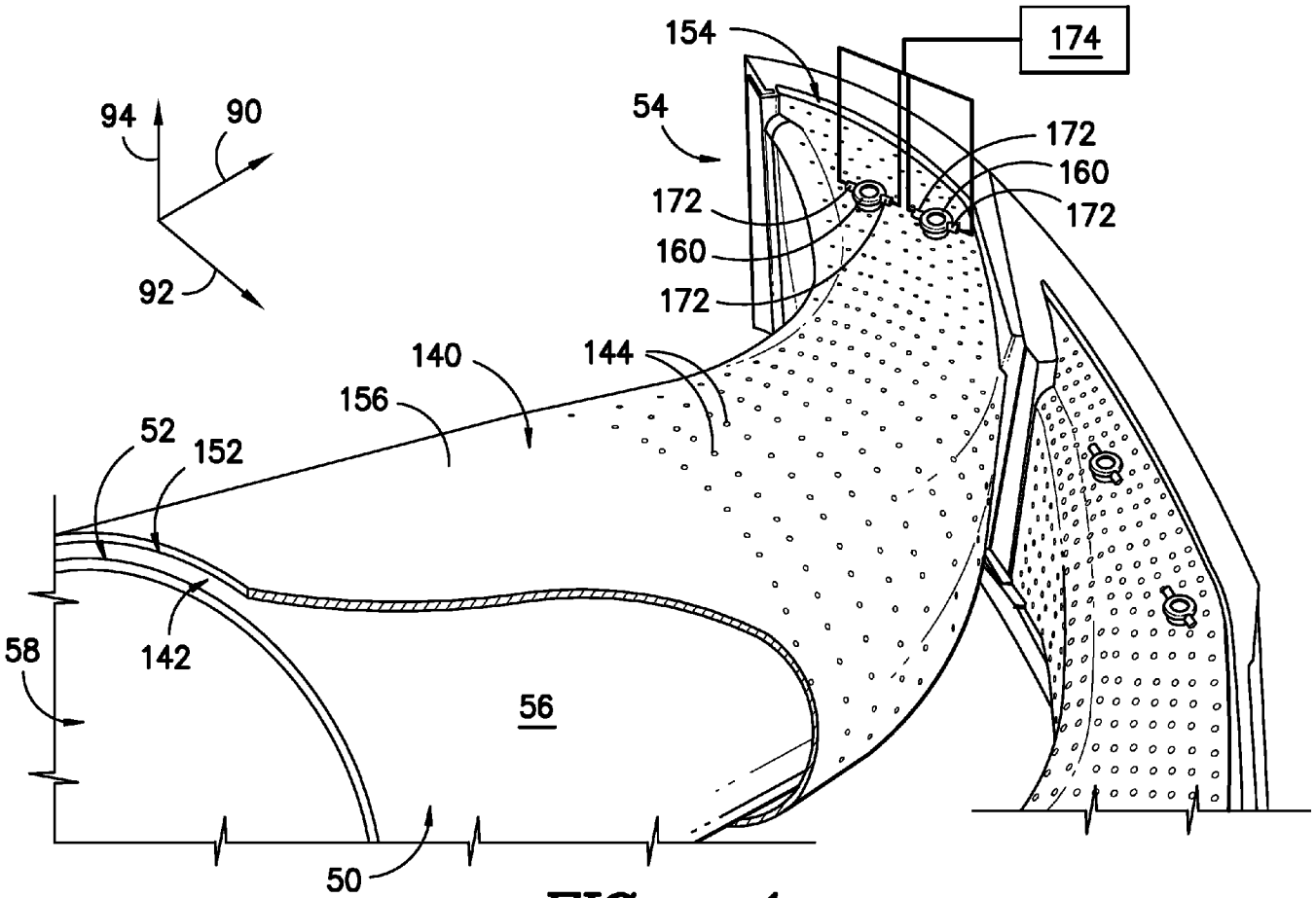
FIG. —4—

*FIG. –7–*

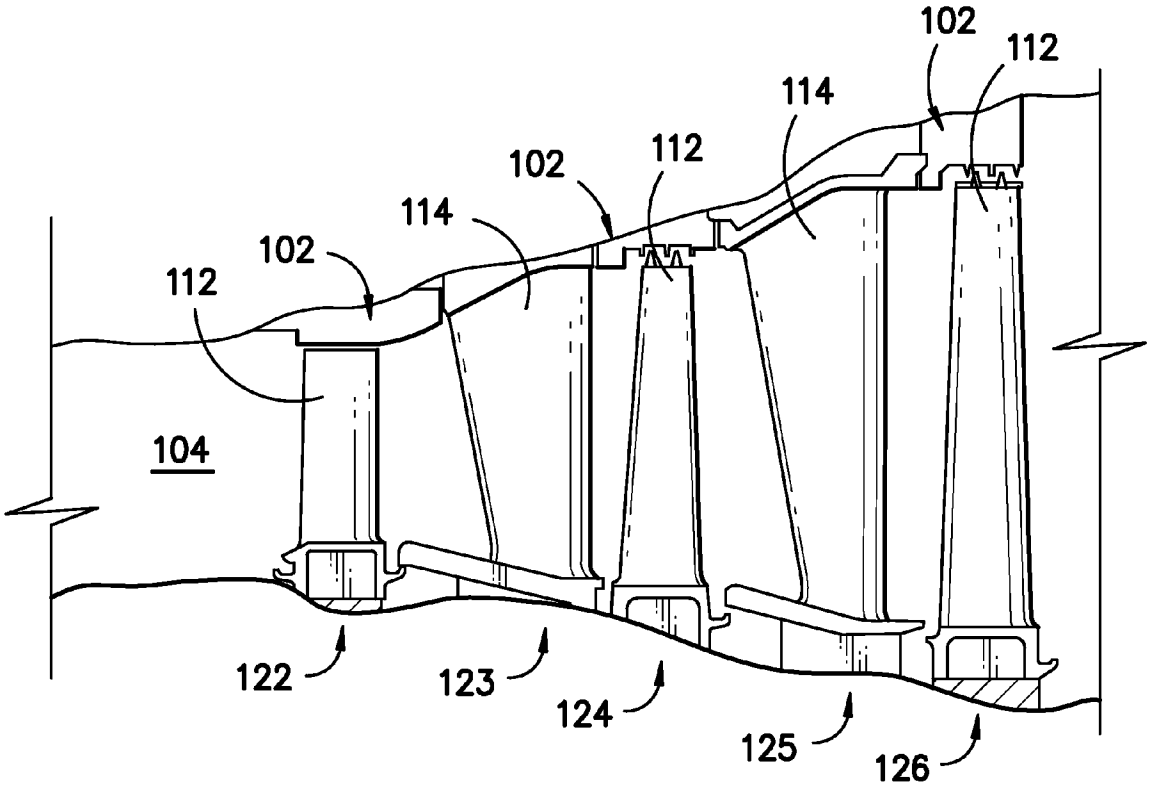
FIG. —10—

TRANSITION DUCT WITH LATE INJECTION IN TURBINE SYSTEM

This invention was made with government support under contract number DE-FC26-05NT42643 awarded by the Department of Energy. The government has certain rights in the invention.

FIELD OF THE INVENTION

The subject matter disclosed herein relates generally to turbine systems, and more particularly to transition ducts having late injection features in turbine systems.

BACKGROUND OF THE INVENTION

Turbine systems are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to drive the compressor, an electrical generator, and other various loads.

The combustor sections of turbine systems generally include tubes or ducts for flowing the combusted hot gas therethrough to the turbine section or sections. Recently, combustor sections have been introduced which include ducts that shift the flow of the hot gas, such as by accelerating and turning the hot gas flow. For example, ducts for combustor sections have been introduced that, while flowing the hot gas longitudinally therethrough, additionally shift the flow radially or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may reduce associated pressure drops and increase the efficiency and power output of the turbine system.

Various design and operating parameters influence the design and operation of combustor sections. For example, higher combustion gas temperatures generally improve the thermodynamic efficiency of the combustor section. However, higher combustion gas temperatures also promote flashback and/or flame holding conditions in which the combustion flame migrates towards the fuel being supplied by fuel nozzles, possibly causing severe damage to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons. These design and operating parameters are of particular concern when utilizing ducts that shift the flow of the hot gas therein, as discussed above.

Accordingly, an improved combustor section for a turbine system would be desired in the art. In particular, an improved system for providing an injection fluid to a combustor section that utilizes ducts that shift the flow of hot gas therein would be desired.

BRIEF DESCRIPTION OF THE INVENTION

Aspects and advantages of the invention will be set forth in part in the following description, or may be obvious from the description, or may be learned through practice of the invention.

In one embodiment, a system for supplying an injection fluid to a combustor is disclosed. The system includes a transition duct comprising an inlet, an outlet, and a passage extending between the inlet and the outlet and defining a longitudinal axis, a radial axis, and a tangential axis. The outlet of the transition duct is offset from the inlet along the longitudinal axis and the tangential axis. The passage defines a combustion chamber. The system further includes a tube providing fluid communication for the injection fluid to flow through the transition duct and into the combustion chamber.

In another embodiment, a system for supplying an injection fluid in a turbine system is disclosed. The system includes a plurality of transition ducts disposed in a generally annular array, each of the plurality of transition ducts comprising an inlet, an outlet, and a passage extending between the inlet and the outlet and defining a longitudinal axis, a radial axis, and a tangential axis. The outlet of each of the plurality of transition ducts is offset from the inlet along the longitudinal axis and the tangential axis. The passage of each of the plurality of transition ducts defining a combustion chamber. The system further includes a plurality of tubes each providing fluid communication for the injection fluid to flow through one of the plurality of transition ducts and into the combustion chamber of that transition duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic view of a gas turbine system according to one embodiment of the present disclosure;

FIG. 2 is a cross-sectional view of several portions of a gas turbine system according to one embodiment of the present disclosure;

FIG. 3 is a perspective view of an annular array of transition ducts and associated impingement sleeves according to one embodiment of the present disclosure;

FIG. 4 is a top rear perspective view of a plurality of transition ducts and associated impingement sleeves according to one embodiment of the present disclosure;

FIG. 10 is a cross-sectional view of a turbine section of a gas turbine system according to one embodiment of the present disclosure.

DETAILED DESCRIPTION OF THE INVENTION

Figure 5:
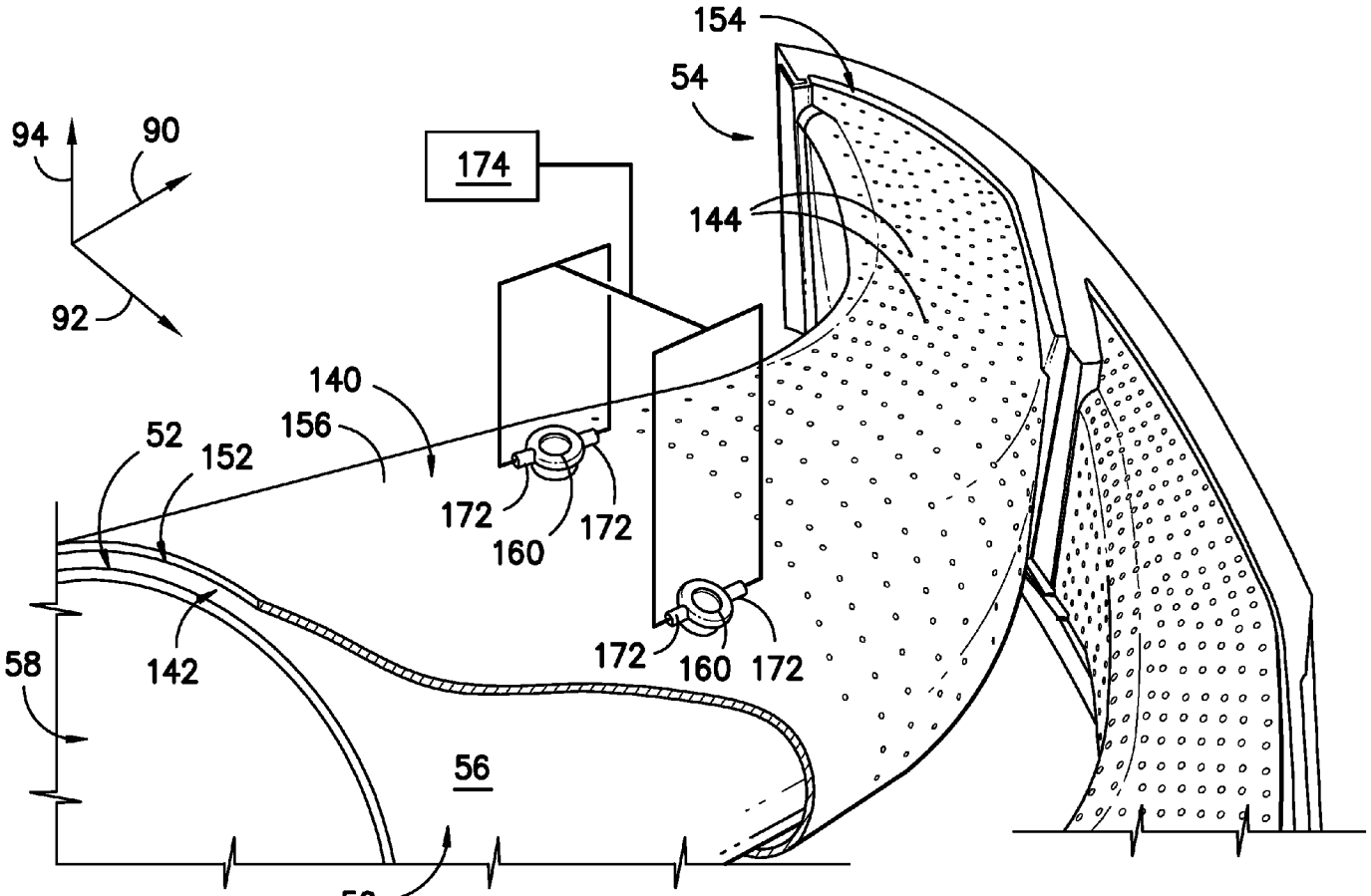
FIG. 5 is a top rear perspective view of a plurality of transition ducts and associated impingement sleeves according to another embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. It should be understood that the turbine system 10 of the present disclosure need not be a gas turbine system 10, but rather may be any suitable turbine system 10, such as a steam turbine system or other suitable system. The gas turbine system 10 may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. Exhaust gases from the system 10 may be exhausted into the atmosphere, flowed to a steam turbine or other suitable system, or recycled through a heat recovery steam generator.

Referring to FIG. 2, a simplified drawing of several portions of a gas turbine system 10 is illustrated. The gas turbine system 10 as shown in FIG. 2 comprises a compressor section 12 for pressurizing a working fluid, which in general is pressurized air but could be any suitable fluid, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

As shown in FIGS. 3 through 9, a combustor 15 according to the present disclosure may include one or more transition ducts 50. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed below, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may reduce or eliminate any associated pressure loss and increase the efficiency and output of the system 10.

Each transition duct 50 may have an inlet 52, an outlet 54, and a passage 56 therebetween. The passage 56 defines a combustion chamber 58 therein, through which the hot gases of combustion flow. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

It should be understood that the tangential axis 92 and the radial axis 94 are defined individually for each transition duct 50 with respect to the circumference defined by the annular array of transition ducts 50, as shown in FIG. 3, and that the axes 92 and 94 vary for each transition duct 50 about the circumference based on the number of transition ducts 50 disposed in an annular array about the longitudinal axis 90.

As discussed, after hot gases of combustion are flowed through the transition duct 50, they may be flowed from the transition duct 50 into the turbine section 16. As shown in FIG. 10, a turbine section 16 according to the present disclosure may include a shroud 102, which may define a hot gas path 104. The shroud 102 may be formed from a plurality of shroud blocks 106. The shroud blocks 106 may be disposed in one or more annular arrays, each of which may define a portion of the hot gas path 104 therein.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 10. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 comprising a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Each transition duct 50 may interface with one or more adjacent transition ducts 50. For example, a transition duct 50 may include one or more contact faces 130, which may be included in the outlet of the transition duct 50. The contact faces 130 may contact associated contact faces 130 of adjacent transition ducts 50, as shown, to provide an interface between the transition ducts 50.

Figure 6:
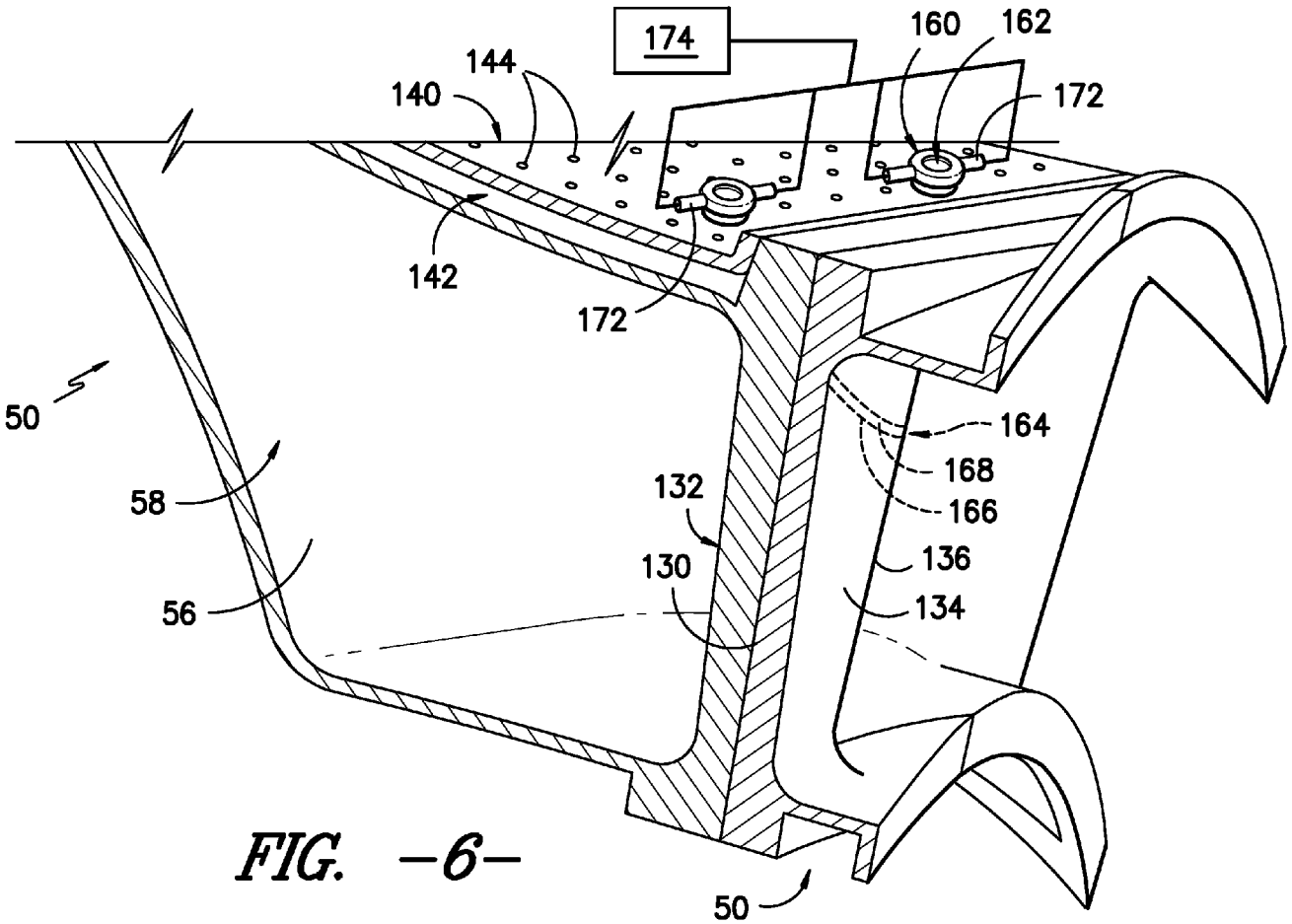
FIG. 6 is a side perspective view of a transition duct and associated impingement sleeve according to one embodiment of the present disclosure.
Figure 7:
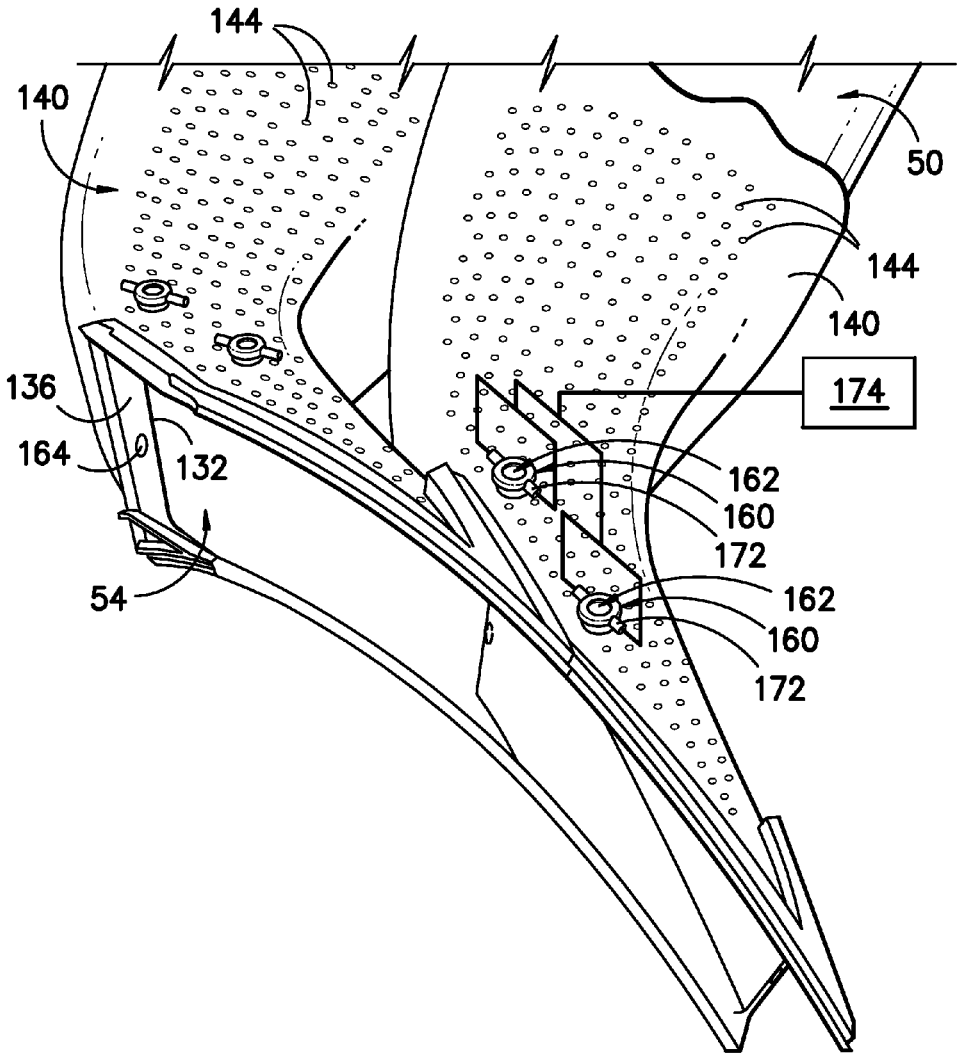
FIG. 7 is a top front perspective view of a plurality of transition ducts and associated impingement sleeves according to one embodiment of the present disclosure.

Further, the adjacent transition ducts 50 may combine to form various surface of an airfoil. These various surfaces may shift the hot gas flow in the transition ducts 50, and thus eliminate the need for first stage nozzles, as discussed above. For example, as shown in FIGS. 6 and 7, an inner surface of a passage 56 of a transition duct 50 may define a pressure side 132, while an opposing inner surface of a passage 56 of an adjacent transition duct 50 may define a suction side 134. When the adjacent transition ducts 50, such as the contact faces 130 thereof, interface with each other, the pressure side 132 and suction side 134 may combine to define a trailing edge 136.

As shown in FIGS. 4 through 9, in exemplary embodiments, flow sleeves 140 may circumferentially surround at least a portion of the transition ducts 50. A flow sleeve 140 circumferentially surrounding a transition duct 50 may define an annular passage 142 therebetween. Compressed working fluid from the casing 21 may flow through the annular passage 142 to provide convective cooling transition duct 50 before reversing direction to flow through the fuel nozzles 40 and into the transition duct 50. Further, in some embodiments, the flow sleeve 140 may be an impingement sleeve. In these embodiments, impingement holes 144 may be defined in the sleeve 140, as shown. Compressed working fluid from the casing 21 may flow through the impingement holes 144 and impinge on the transition duct 50 before flowing through the annular passage 142, thus providing additional impingement cooling of the transition duct.

Each flow sleeve 140 may have an inlet 152, an outlet 154, and a passage 156 therebetween. Each flow sleeve 140 may extend between a fuel nozzle 40 or plurality of fuel nozzles 40 and the turbine section 16, thus surrounding at least a portion of the associated transition duct 50. Thus, similar to the transition ducts 50, as discussed above, the outlet 154 of each of the plurality of flow sleeves 140 may be longitudinally, radially, and/or tangentially offset from the inlet 152 of the respective flow sleeve 140.

As shown in FIGS. 4 through 9, each combustor 15 may further include one or more late injectors or tubes 160. In some embodiments, one or more tubes 160 may be circumferentially arranged around each transition duct 50 and combustion chamber 58 thereof, as well as the associated flow sleeve 140. The tubes 160 are located downstream from the fuel nozzles 40. Each tube 160 may be in fluid communication with the combustion chamber 58 of an associated transition duct 50. A tube 160 may thus provide fluid communication for an injection fluid to flow through the associated flow sleeve 140 and transition duct 50, such as through the passage 156 and passage 156 walls thereof, and into the combustion chamber 58. The tubes 160 may thus provide a late injection of injection fluid into the combustion chamber 58.

The injection fluid may include fuel and, optionally, working fluid. In some embodiments, the injection fluid may be a lean mixture of fuel and working fluid, and may thus be provided as a late lean injection. In other embodiments, the injection fluid may be only fuel, without any working fluid, or may be another suitable mixture of fuel and working fluid.

Figure 8:
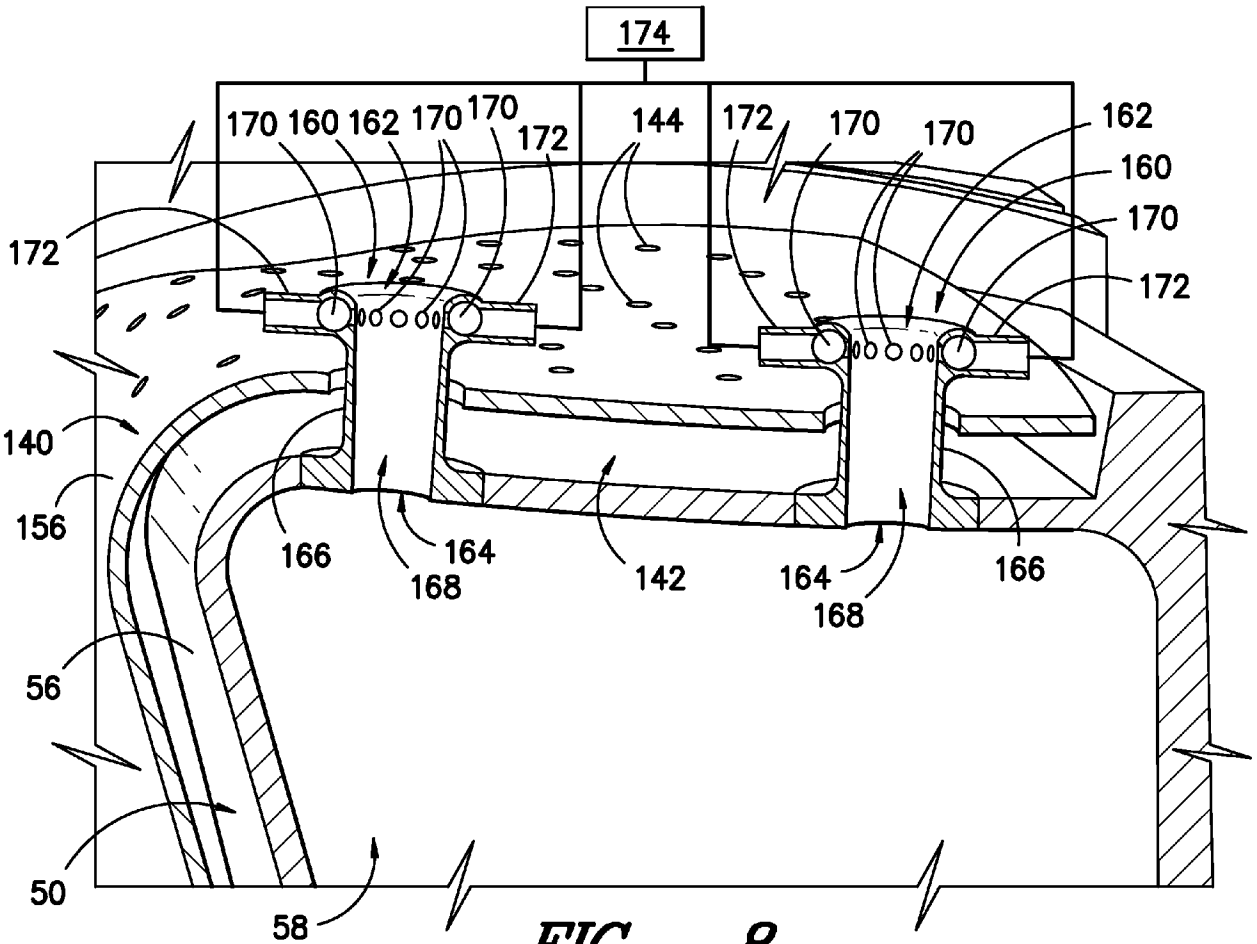
FIG. 8 is a cross-sectional view of a transition duct and associated impingement sleeve according to one embodiment of the present disclosure.
Figure 9:
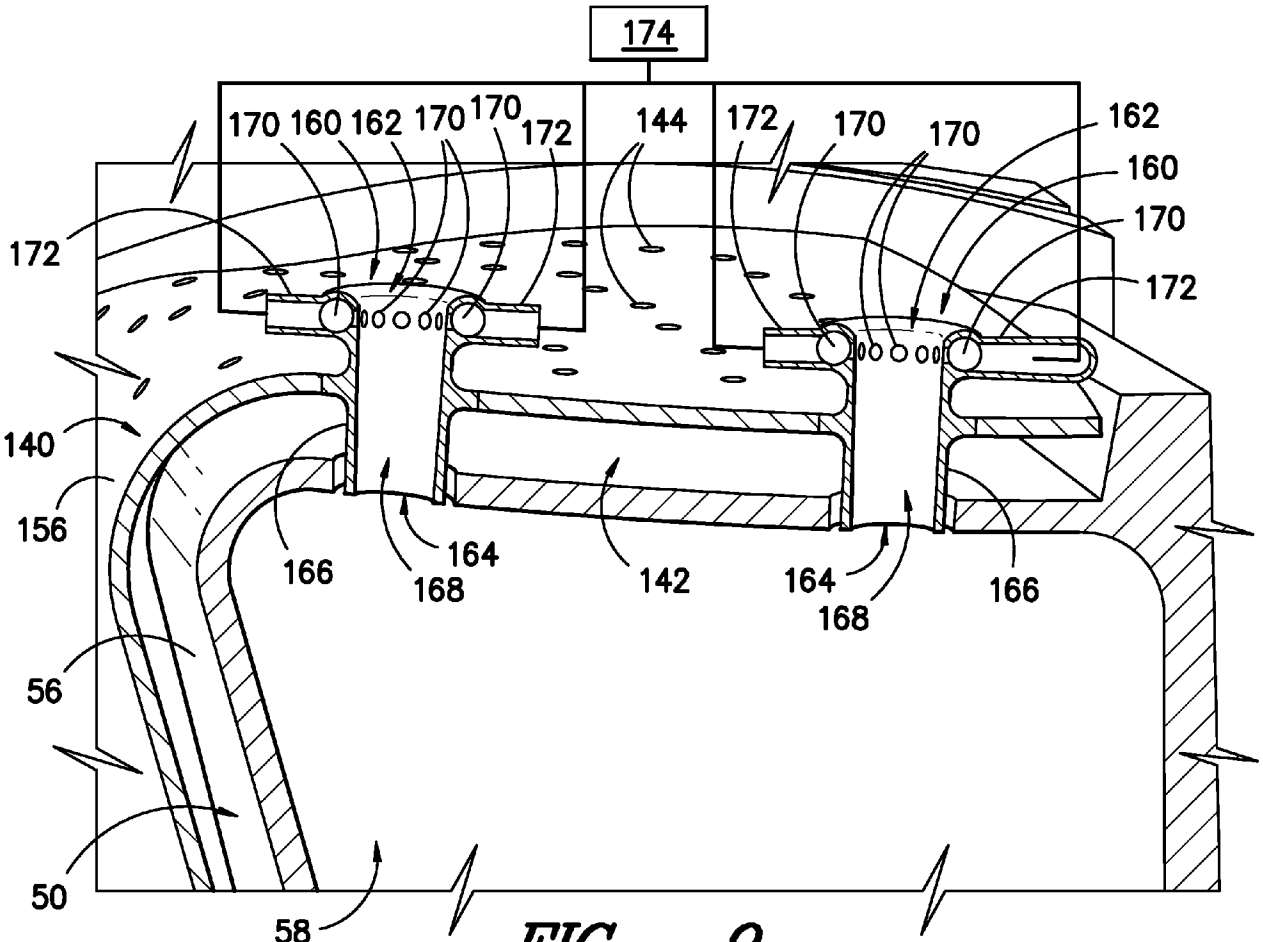
FIG. 9 is a cross-sectional view of a transition duct and associated impingement sleeve according to another embodiment of the present disclosure.

As shown in FIGS. 8 and 9, each tube 160 may in some embodiments have an inlet 162, an outlet 164, and a passage 166 therebetween. The passage 166 defines a chamber 168 therein. The inlet 162 of a tube 162 may be in fluid communication with the casing 21. Thus, a portion of the compressed working fluid exiting the compressor section 12 may flow from inside the casing 21 into the chamber 168 through the inlet 162 of a tube 160, and through the tubes 160 to mix with fuel to produce an injection fluid.

In exemplary embodiments, one or more fuel conduits 170 may be defined in a tube 160. The fuel conduits 170 may, for example, be circumferentially arranged about a tube 160 as shown. Each fuel conduit 170 may provide fluid communication for a fuel to flow into the tube 160 through the fuel conduit 170. In embodiments wherein the tube 160 includes an inlet 162 allowing working fluid therein, the fuel and working fluid may mix within the chamber 168 to produce the injection fluid. In other embodiments, a tube 160 may not include an inlet 162, and no working fluid may be flowed into the tube 160. In these embodiments, the injection fluid may include fuel, without such compressed working fluid included therein.

As shown, one or more fuel ports 172 may be provided in fluid communication with each tube 160. For example, each fuel port 172 may be in fluid communication with the tube 160 and chamber 168 thereof through a fuel conduit 170. Fuel may be supplied from a fuel source 174 through each fuel port 172, and from a fuel port 172 through a fuel conduit 170 into a chamber 168.

The injection fluid produced in the chamber 168 of each tube 160 may be flowed, or injected, from each tube 160 into the combustion chamber 58. By injecting the injection fluid downstream of the fuel nozzles 40, and thus downstream of the location of initial combustion, such injection results in additional combustion that raises the combustion gas temperature and increases the thermodynamic efficiency of the combustor 15. The addition of tubes 160 to such combustors is thus effective at increasing combustion gas temperatures without producing a corresponding increase in the production of $NO_X$. Further, the use of such tubes 160 is particularly advantageous in combustors 15 that utilize transition ducts 50.

The outlet 164 of each tube 160 may exhaust the injection fluid at any suitable location along the transition duct 50 that is downstream of the fuel nozzles 40. For example, in some embodiments as shown in FIG. 4, one or more tubes 160 may be located in and/or may have an outlet 164 that exhausts into an aft portion of the transition duct 50. The aft portion may be, for example, an aft 50% or 25% of a length of the transition duct 50, as measured from the outlet 54 of the transition duct and generally along the longitudinal axis 90. In other embodiments as shown in FIG. 5, one or more tubes 160 may be located in and/or may have an outlet 164 that exhausts into a forward portion of the transition duct 50. The forward portion may be, for example, a forward 50% or 25% of a length of the transition duct 50, as measured from the inlet 52 of the transition duct and generally along the longitudinal axis 90. Further, in some exemplary embodiments, as shown in FIGS. 6 and 7, an outlet 164 may be defined in a trailing edge 136 formed by the inner surfaces of adjacent transition ducts 50. In other embodiments, an outlet 164 may be defined in a pressure side 132 or a suction side 134. These embodiments may be particularly advantageous in providing late injection benefits, because of the location of the trailing edge 136, as well as the pressure side 132 and suction side 134, of a transition duct 50 relative to the fuel nozzle 40 and relative to the turbine section 16. In other embodiments, however, an outlet 164 may be defined in the inner surface of the passage 56 of a transition duct 50 at any suitable location downstream of the fuel nozzles 40.

As discussed, a tube 160 according to the present disclosure may extend through an associated transition piece 50, and passage 56 thereof, and associated flow sleeve 140, and passage 156 thereof. In some embodiments, as shown in FIG. 8, a tube 160 may be mounted to the transition piece 50. For example, the tube 160 may be welded as shown, or mechanically fastened or otherwise mounted, to the passage 56. In other embodiments, as shown in FIG. 9, a tube 160 may be mounted to the flow sleeve 140. For example, the tube 160 may be welded as shown, or mechanically fastened or otherwise mounted, to the passage 156. In still other embodiments, a tube 160 may be otherwise mounted to any suitable component of the combustor section 14 or turbine system 10 in general.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supplying an injection fluid to a combustor, the injection fluid comprising a fuel, the system comprising:

a transition duct comprising an inlet, an outlet, and a passage extending between the inlet and the outlet and defining a longitudinal axis, a radial axis, and a tangential axis, the outlet of the transition duct offset from the inlet along the longitudinal axis and the tangential axis, the passage defining a combustion chamber;

an impingement sleeve circumferentially surrounding at least a portion of the transition duct; and a tube providing fluid communication for the injection fluid to flow through the transition duct and impingement sleeve and into the combustion chamber, the tube extending through the transition duct and the impingement sleeve.

2. The system of claim 1, further comprising a fuel conduit providing fluid communication for flowing the fuel into the tube.

3. The system of claim 2, further comprising a fuel port in fluid communication with the tube through the fuel conduit.

4. The system of claim 1, wherein an inlet of the tube is in fluid communication with a casing surrounding the transition duct to flow a working fluid into the tube.

5. The system of claim 1, wherein an inner surface of the transition duct at least partially defines a trailing edge, and wherein an outlet of the tube is defined in the trailing edge.

6. The system of claim 1., wherein the outlet of the transition duct is further offset from the inlet along the radial axis.

7. The system of claim 1, further comprising a turbine section in communication with the transition duct, the turbine section comprising a first stage bucket assembly.

8. The system of claim 7, wherein no nozzles are disposed upstream of the first stage bucket assembly.

9. A system for supplying an injection fluid in a turbine system, the injection fluid comprising a fuel, the system comprising:

a plurality of transition ducts disposed in a generally annular array, each of the plurality of transition duets comprising an inlet, an outlet, and a passage extending between the inlet and the outlet and defining a longitudinal axis, a radial axis, and a tangential axis, the outlet of the transition duct offset from the inlet along the longitudinal axis and the tangential axis, the passage of each of the plurality of transition ducts defining a combustion chamber;

a plurality of impingement sleeves each circumferentially surrounding at least a portion of one of the plurality of transition ducts; and a plurality of tubes each providing fluid communication for the injection fluid to flow through one of the plurality of transition ducts and one of the plurality of impingement sleeves and into the combustion chamber of that transition duct, each of the plurality of tubes extending through one of the plurality of transition ducts and one of the plurality of impingement sleeves.

10. The system of claim 9, further comprising a fuel conduit providing fluid communication for flowing the fuel into each of the plurality of tubes.

11. The system of claim 10, further comprising a fuel port in fluid communication with each of the plurality of tubes through each fuel conduit.

12. The system of claim 9, wherein an inlet of each of the plurality of tubes is in fluid communication with a casing surrounding the transition duct to flow a working fluid into that tube.

13. The system of claim 9, wherein an inner surface of each of the plurality of transition ducts at least partially defines a trailing edge, and wherein an outlet of each of the plurality of tubes is defined in the trailing edge of one of the plurality of transition ducts.

14. The system of claim 9, wherein the outlet of each of the plurality of transition ducts is further offset from the inlet of that transition duct along the radial axis.

15. The system of claim 9, further comprising a turbine section in communication with the plurality of transition ducts, the turbine section comprising a plurality of first stage bucket assemblies.

16. The system of claim 15, wherein no nozzles are disposed upstream of the first stage bucket assemblies.

17. A system for supplying an injection fluid in a turbine system, the injection fluid comprising a fuel, the system comprising:

a plurality of transition ducts disposed in a generally annular array, each of the plurality of transition ducts comprising an inlet, an outlet, and a passage extending between the inlet and the outlet and defining a longitudinal axis, a radial axis, and a tangential axis, the outlet of the transition duct offset from the inlet along the longitudinal axis and the tangential axis, the passage of each of the plurality of transition ducts defining a combustion chamber; and a plurality of tubes each providing fluid communication for the injection fluid to flow through one of the plurality of transition ducts and into the combustion chamber of that transition duct, wherein contact faces of adjacent transition ducts of the plurality of transition ducts form an airfoil shape defining a pressure side, a suction side, and a trailing edge between the pressure side and the suction side, and wherein an outlet of each of the plurality of tubes is defined in one of the pressure side, the suction side or the trailing edge of one of the plurality of transition ducts.

18. The system of claim 17, wherein the outlet of each of the plurality of tubes is defined in the trailing edge of one of the plurality of transition ducts.

* * * * *